US011448106B2

(12) United States Patent
Ishigami et al.

(10) Patent No.: US 11,448,106 B2
(45) Date of Patent: Sep. 20, 2022

(54) SEALING STRUCTURE

(71) Applicants: Mahle International GmbH, Stuttgart (DE); Mahle Filter Systems Japan Corporation, Tokyo (JP)

(72) Inventors: Shintaro Ishigami, Tokyo (JP); Daizo Ito, Tokyo (JP); Satoshi Komiyama, Tokyo (JP); Atsushi Nonaka, Tokyo (JP)

(73) Assignees: M AHLE INTERNATIONAL GM BH; M AHLE FILTER SYSTEM S JAPAN CORPORATION

( * ) Notice: Subject to any disclaimer, the term of this patent is extended or adjusted under 35 U.S.C. 154(b) by 30 days.

(21) Appl. No.: 17/064,586

(22) Filed: Oct. 6, 2020

(65) Prior Publication Data

US 2021/0102483 A1 Apr. 8, 2021

(30) Foreign Application Priority Data

Oct. 7, 2019 (JP) ..... JP2019-184414

(51) Int. Cl.
*F01M 11/04* (2006.01)
*F01M 11/00* (2006.01)

(52) U.S. Cl.
CPC ..... *F01M 11/0408* (2013.01); *F01M 11/0004* (2013.01); *F01M 2011/0416* (2013.01)

(58) Field of Classification Search
CPC ..... F01M 11/0408; F01M 11/0004; F01M 2011/0416; F01M 11/04; F02F 11/00
See application file for complete search history.

(56) References Cited

FOREIGN PATENT DOCUMENTS

| | | | | |
|---|---|---|---|---|
| DE | 102016202692 A1 | | 8/2017 | |
| JP | 2019-100222 A | | 6/2019 | |
| JP | 2019100222 A | * | 6/2019 | ..... F01M 11/0004 |

OTHER PUBLICATIONS

German Search Report dated Nov. 2, 2020 related to corresponding German Patent Application No. 10 2020 212 527.9.
English abstract for JP-2019-100222.

* cited by examiner

*Primary Examiner* — Jacob M Amick
*Assistant Examiner* — Charles J Brauch
(74) *Attorney, Agent, or Firm* — Fishman Stewart PLLC

(57) ABSTRACT

[Problem to be Solved] To improve operability in detaching a sealing member.
[Solution] A sealing structure 10 according to the present invention includes a main body 30*a*, a female thread part 20*h* fixed to the main body 30*a*, the female thread part 20*h* being screwed into a discharge hole 20*c* of a drain plug fastening part 20 by the main body 30*a* being rotated in a normal rotation direction, and an elastically deformable arm part 30*c*, one end of which is joined to the main body 30*a*. A concave part 20*e* is formed in the drain plug fastening part 20 and a claw part 30*g* is formed in the arm part 30*c*. When the main body 30*a* is rotated in the normal rotation direction, the arm part 30*c* is elastically deformed while a part of the arm part 30*c* slides on a top surface 20*d* of the drain plug fastening part 20 until the main body 30*a* is rotated to a predetermined rotational position and, when the main body 30*a* is rotated to the predetermined rotational position, the claw part 30*g* fits in the concave part 20*e* and the elastic deformation of the arm part 30*c* is released, whereby the rotation of the main body 30*a* from the predetermined rotational position is prevented. When the main body 30*a* is rotated in a reverse rotation direction from the predetermined rotational position, the claw part 30*g* slides on and (Continued)

climbs over a first wall part 20*f* of the concave part 20*e* while the arm part 30*c* is elastically deformed, whereby the prevention of the rotation of the main body 30*a* from the predetermined rotational position is released. The claw part 30*g* or the concave part 20*e* is formed such that, when the main body 30*a* is rotated in the reverse rotation direction and the claw part 30*g* is sliding on the first wall part 20*f*, an angle A formed by a direction of force applied to the arm part 30*c* from the drain plug fastening part 20 and a straight line connecting a contact part of the claw part 30*g* and the first wall part 20*f* and a rotation center of the main body 30*a* is smaller than 90 degrees when viewed in a rotation center direction of the main body 30*a*.

20 Claims, 16 Drawing Sheets

P-P

Q-Q

SEALING STRUCTURE

CROSS-REFERENCE TO RELATED APPLICATION

This application claims priority to Japanese Application No. JP 2019184414 filed on Oct. 7, 2019, the contents of which are hereby incorporated by reference in its entirety.

TECHNICAL FIELD

The present invention relates to a sealing structure and, more particularly, to a sealing structure of an oil pan by a drain plug.

BACKGROUND

There has been known a sealing structure for sealing an opening part of a predetermined member with a sealing member, such as a drain plug, the sealing structure being detached from the predetermined member by being rotated in a reverse rotation direction, for example, using a predetermined tool. As an example of such a sealing structure, there has been proposed a drain plug structure of an oil pan including locking meshing parts that are formed at both of distal end portions of arcuate arm parts and an opening edge part of the drain hole and fit with each other in a recess-protrusion manner to exert a locking function (see, for example, Patent Literature 1).

[Patent Literature 1] Japanese Patent Application Laid-Open No. 2019-100222

SUMMARY

The sealing structure described in Patent Literature 1 includes the arcuate arm parts. When the sealing member is rotated in the reverse rotation direction and detached from the predetermined member such as the oil pan, force is applied to the arcuate arm parts 15 in a direction parallel to the tangent of an arc. That is, an angle formed by a straight line connecting a part, where the force is applied to the arcuate arm parts 15, and a rotation center, and a direction of the force applied to the arcuate arm parts 15 is a right angle. As a result of the researches and developments by the inventor, it has been found that, when such force in the direction is applied to the arcuate arm parts 15, force is applied to the arcuate arm parts 15 in a radial outward direction and, when the sealing member is rotated in the reverse rotation direction, not only step surface climbing reaction at the time when engaging convex parts (locking meshing parts) 16 at the distal ends of the arcuate arm parts 15 climb over a step of an engaging concave part (a locking meshing part) 17 but also reaction due to a bend outward in a rotating direction of the arcuate arm parts 15 is large and discomfort occurs in operation. Accordingly, there has been room of improvement in operability in detaching the sealing member.

Therefore, the present invention has been devised in view of the above problem and an object of the present invention is to improve operability in detaching the sealing member from the predetermined member.

In order to solve the problem, a sealing structure according to the present invention includes: a predetermined member including an opening part; and a sealing member that seals the opening part of the predetermined member. The sealing member includes: a main body, a thread part fixed to the main body, wherein if the main body is rotated in a normal rotation direction, the thread part is screwed into the opening part of the predetermined member; and an elastically deformable arm part joined to the main body at one end thereof. A convex part is formed in one of the predetermined member and the arm part and a concave part is formed in another of the predetermined member and the arm part. If the main body is rotated in the normal rotation direction, the arm part is elastically deformed while a part of the arm part slides on a surface of the predetermined member until the main body is rotated to a predetermined rotational position and, when the main body is rotated to the predetermined rotational position, the convex part fits in the concave part and the elastic deformation of the arm part is released, whereby the rotation of the main body from the predetermined rotational position is prevented. If the main body is rotated in a reverse rotation direction from the predetermined rotational position, the convex part slides on and climbs over a wall part of the concave part while the arm part is elastically deformed, whereby the prevention of the rotation of the main body from the predetermined rotational position is released. The convex part or the concave part is formed such that, when the main body is rotated in the reverse rotation direction and the convex part is sliding on the wall part, an angle A formed by a direction of force applied to the arm part from the predetermined member and a straight line connecting a contact part of the convex part and the wall part and a rotation center of the main body is smaller than 90 degrees when viewed in a rotation center direction of the main body.

With this form, when the sealing member is rotated in the reverse rotation direction, for example, using a predetermined tool, it is possible to suppress the arm part from being rotated around the contact part by force applied to the arm part from the predetermined member. Accordingly, it is possible to improve operability in detaching the sealing member from the predetermined member.

When an angle formed by a straight line connecting the contact part of the convex part and the wall part and a joined part of the arm part and the main body and the straight line connecting the contact part of the convex part and the wall part and the rotation center of the main body is represented as an angle B, the convex part or the concave part may be formed such that 90 degrees>the angle A≥the angle B holds.

With this form, it is possible to further suppress the arm part from being rotated around the contact part by the force applied to the arm part from the predetermined member. Accordingly, it is possible to further improve operability in detaching the sealing member from the predetermined member.

The convex part or the concave part may be formed such that the angle A and the angle B are equal. With this form, it is possible to avoid the arm part being rotated around the contact part by the force applied to the arm part from the predetermined member. Accordingly, it is possible to greatly improve the operability in detaching the sealing member from the predetermined member.

Note that the concave part may be formed in the predetermined member and the convex part may be formed in the arm part. The convex part may be formed in the predetermined member and the concave part may be formed in the arm part.

The predetermined member may be made of resin. Since the convex part is fit in the concave part, reverse rotation of the sealing member can be prevented even if the sealing member is not screwed into the predetermined member with strong torque. Accordingly, it is possible to improve reliability of the thread part even when the predetermined member is resin.

The predetermined member may be an oil pan and the sealing member may be a drain plug. With this form, it is possible to improve operability in detaching the drain plug from the oil pan.

According to the present invention, it is possible to improve operability in detaching the sealing member.

DETAILED DESCRIPTION

Figure 1:
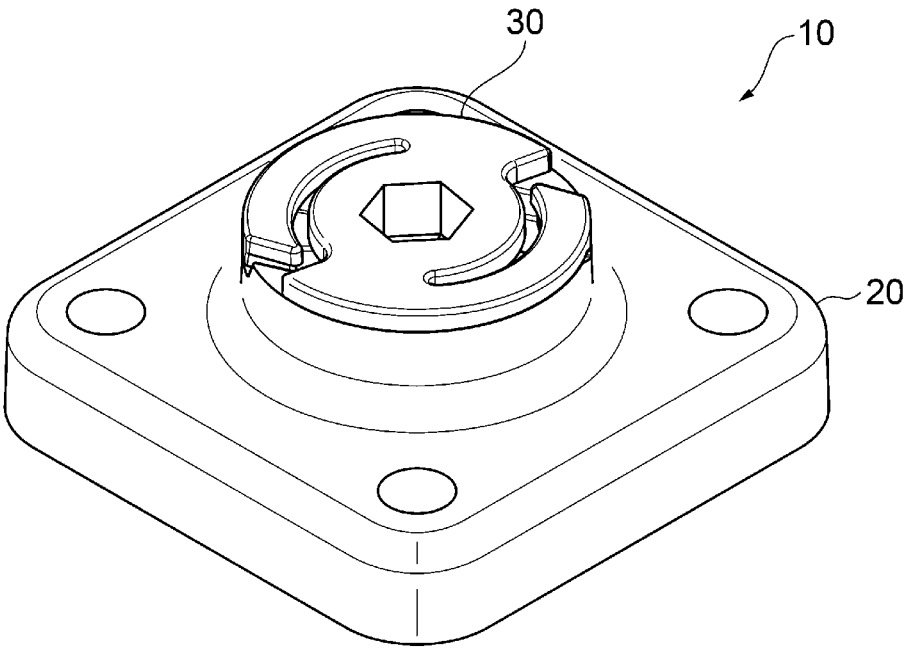
FIG. 1 is a perspective view showing a sealing structure according to a first embodiment.

FIG. 1 is a perspective view showing a sealing structure 10 according to a first embodiment. The sealing structure 10 includes a drain plug fastening part 20 (a predetermined member) and a drain plug 30 (a sealing member).

Figure 2:
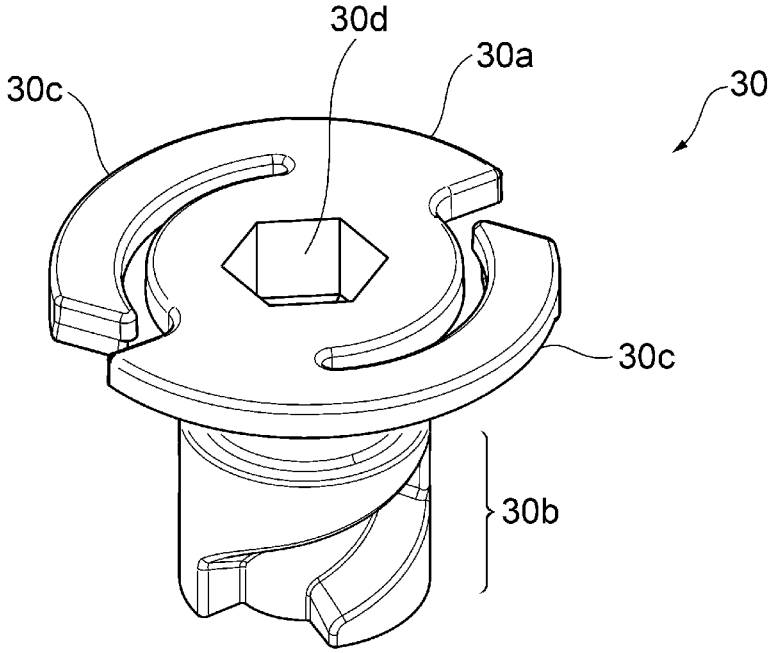
FIG. 2 is a perspective view showing a drain plug according to the first embodiment.
Figure 3:
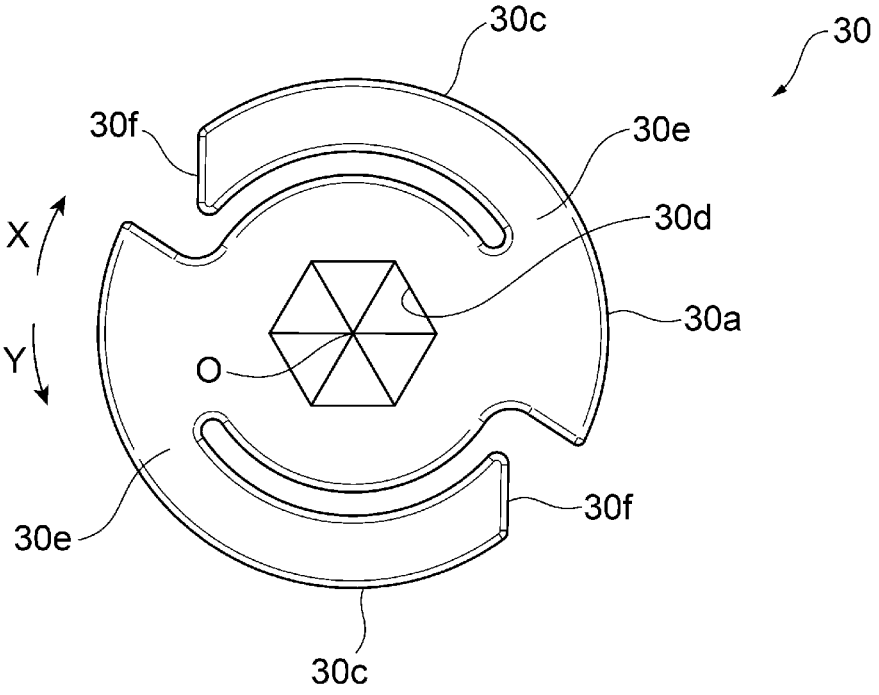
FIG. 3 is a front view of the drain plug according to the first embodiment.
Figure 4:
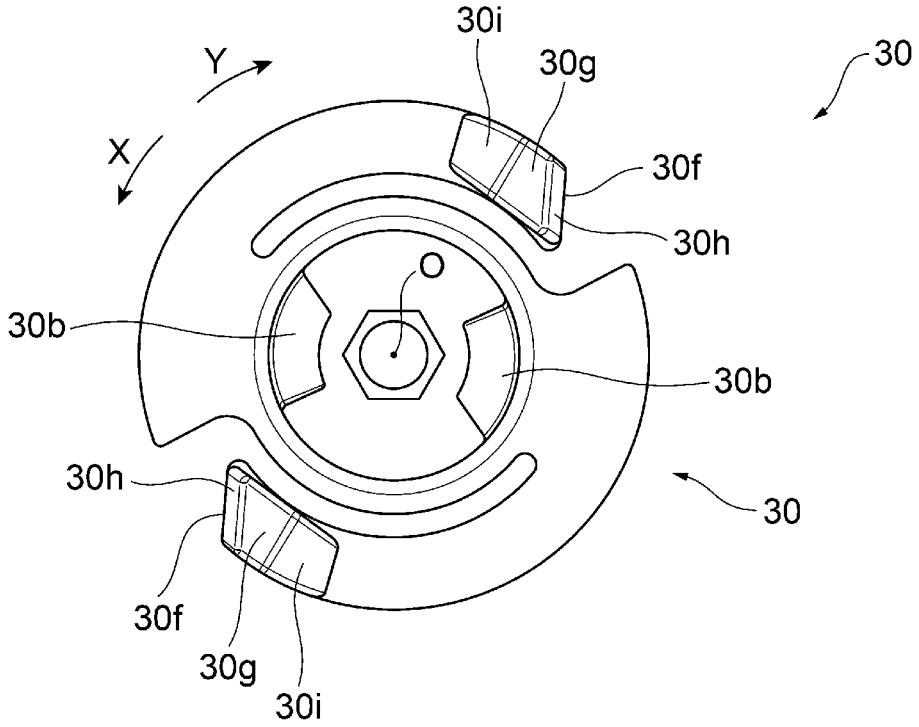
FIG. 4 is a rear view of the drain plug according to the first embodiment.

FIG. 2 is a perspective view showing the drain plug 30 according to the first embodiment. FIG. 3 is a front view of the drain plug 30 according to the first embodiment. FIG. 4 is a rear view of the drain plug 30 according to the first embodiment. The drain plug 30 includes a main body 30*a*, a male thread part 30*b*, and an arm part 30*c*.

The main body 30*a* is generally formed in a columnar shape. The main body 30*a* is rotated in a normal rotation direction X to thereby be screwed into a discharge hole explained below of the drain plug fastening part 20. Consequently, the discharge hole of the drain plug fastening part 20 is closed.

The arm part 30*c* is formed in an arcuate shape coaxial with a rotation center O of the main body 30*a*. One end of the arm part 30*c* is joined to the main body 30*a*. The main body 30*a*, the male thread part 30*b*, and the arm part 30*c* are integrally formed by resin. Accordingly, the arm part 30*c* is elastically deformable. In the first embodiment, the drain plug 30 includes two arm parts 30*c*. However, the drain plug 30 may include one or three or more arm parts 30*c*.

A claw part 30*g* (a convex part) is formed at the other end 30*f* of the arm part 30*c*. The other end 30*f* of the arm part 30*c* is present further in a reverse rotation direction Y than one end joined to the main body 30*a*. The claw part 30*g* is formed on the lower side of the arm part 30*c*, that is, the male thread part 30*b* side.

The claw part 30*g* includes a first inclined part 30*h* and a second inclined part 30*i*. The first inclined part 30*h* is present further in the reverse rotation direction Y than the second inclined part 30*i*. The first inclined part 30*h* and the second inclined part 30*i* are inclined to be closer to each other as progress toward a projecting direction of the claw part 30*g*. The second inclined part 30*i* extends on a straight line that passes the rotation center O. The first inclined part 30*h* is inclined with respect to the straight line passing the rotation center O to advance in a normal rotation direction X as advance toward a radial direction outer side.

The male thread part 30*b* is formed to extend coaxially with the main body 30*a* from one end portion of the main body 30*a*. The male thread part 30*b* is formed as a spiral groove. A pitch and a groove width of the male thread part 30*b* are extremely larger than those of a normal screw such that the drain plug 30 can be attached to the drain plug fastening part 20 by rotating the drain plug 30 once or less.

The drain plug 30 further includes a tool insertion hole 30*d*. The tool insertion hole 30*d* is disposed as a concave part at the other end portion of the main body 30*a*. In the first embodiment, the tool insertion hole 30*d* is formed as a hexagonal concave part when viewed from the front such that a hexagonal wrench is fit into the tool insertion hole 30*d*. However, for example, a projecting part having a hexagonal prism shape may be formed instead of the tool insertion hole 30*d*.

Figure 5:
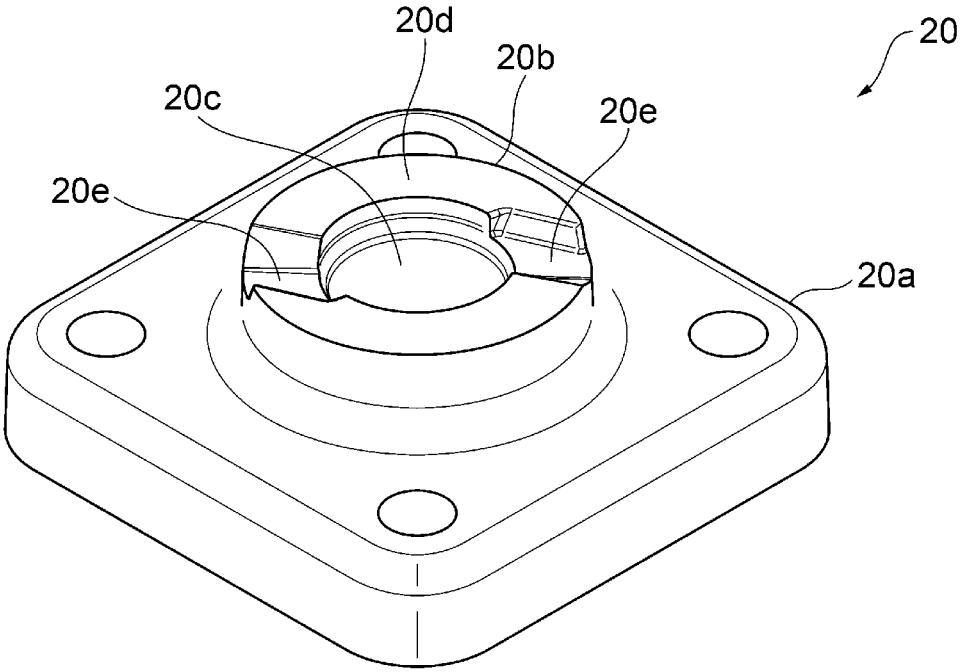
FIG. 5 is a perspective view showing a drain plug fastening part according to the first embodiment.
Figure 6:
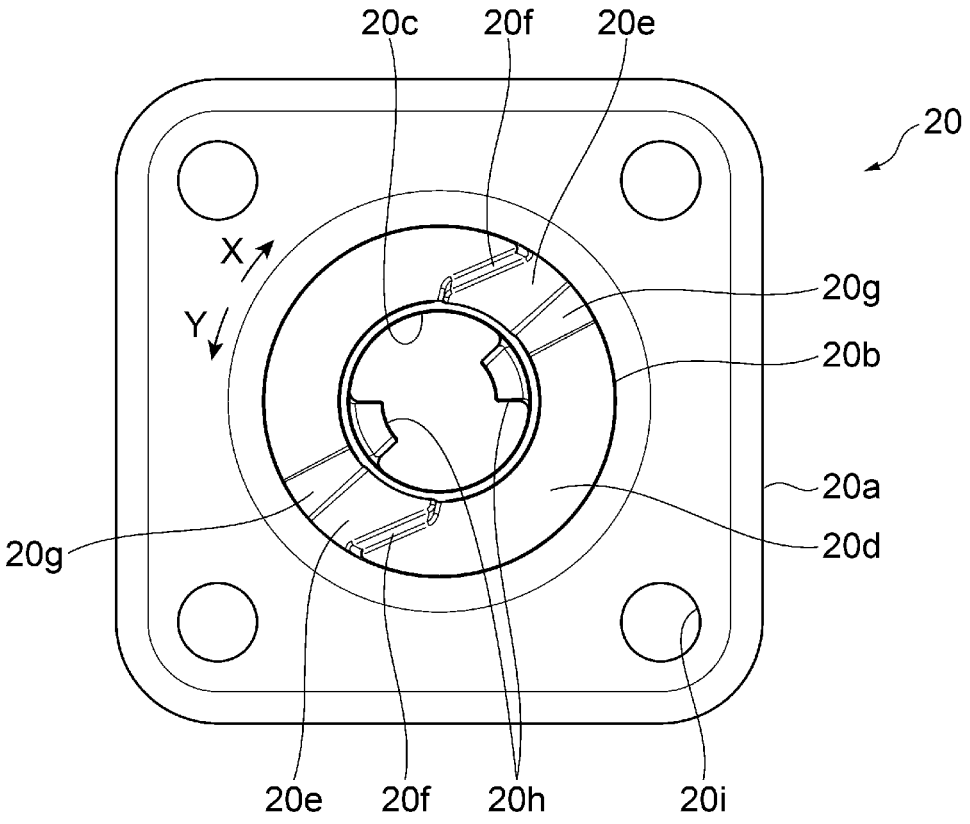
FIG. 6 is a front view of the drain plug fastening part according to the first embodiment.

FIG. 5 is a perspective view showing the drain plug fastening part 20 according to the first embodiment. FIG. 6 is a front view of the drain plug fastening part 20 according to the first embodiment. The drain plug fastening part 20 includes a base part 20*a*, a projecting part 20*b*, and a discharge hole 20*c*. The base part 20*a* is formed in a rectangular parallelepiped shape. Four attachment holes 20*i* are formed in the base part 20*a*. The drain plug fastening part 20 is fixed to an oil pan main body through the attachment holes 20*i* using a fastening tool. Therefore, the drain plug fastening part 20 forms a part of the oil pan.

The projecting part 20*b* projects from one surface of the base part 20*a*. The projecting part 20*b* is formed in a columnar shape. A top surface 20*d*, which is an annular plane, is formed at the distal end of the projecting part 20*b*. A concave part 20*e* is formed to recess from the top surface 20*d*.

The concave part 20*e* includes a first wall part 20*f* and a second wall part 20*g*. The first wall part 20*f* is present further in the reverse rotation direction Y than the second wall part 20*g*. When the drain plug 30 is rotated in the reverse rotation direction Y, the first wall part 20*f* comes into contact with the first inclined part 30*h* of the drain plug 30. When the drain plug 30 is rotated in the normal rotation direction X, the second wall part 20*g* comes into contact with the second inclined part 30*i* of the drain plug 30. Accordingly, an inclination angle of the first wall part 20*f* is the same as an inclination angle of the first inclined part 30*h*. An inclination angle of the second wall part 20*g* is the same as an inclination angle of the second inclined part 30*i*.

The second wall part 20*g* extends on a straight line that passes the rotation center O. The first wall part 20*f* is inclined with respect to the straight line passing the rotation center O to advance in the normal rotation direction X as advance toward the radial direction outer side.

The discharge hole 20*c* is formed in the center of the projecting part 20*b*. A female thread part 20*h* is formed in the discharge hole 20*c*. The female thread part 20*h* is formed as a projecting part projecting in a radial inward direction from the discharge hole 20*c*.

Figure 7:
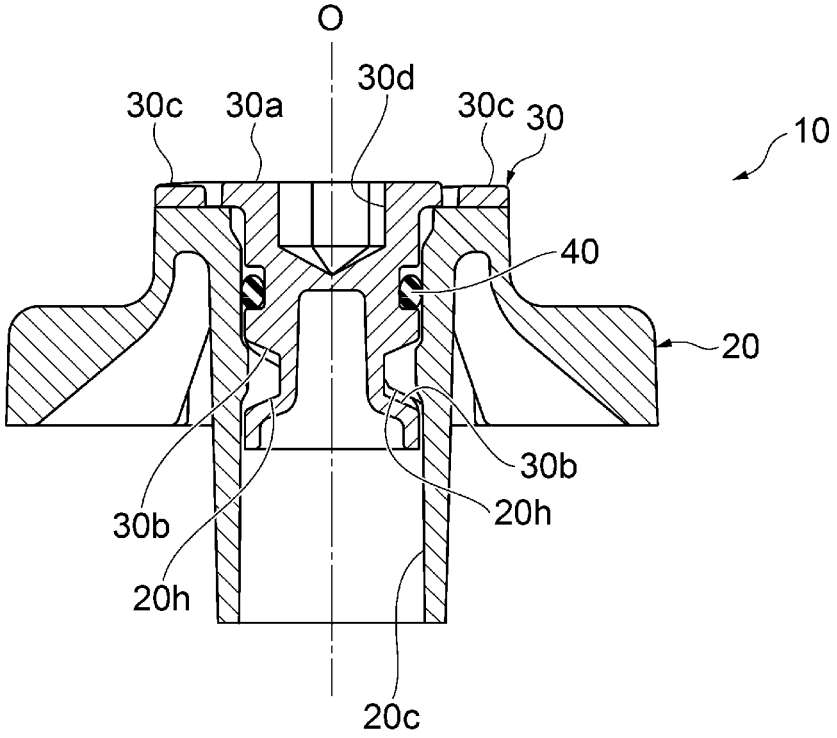
FIG. 7 is a sectional view of a sealing structure by a plane including a rotation center.

FIG. 7 is a sectional view of the sealing structure 10 by a plane including the rotation center O. The sealing structure 10 further includes a seal member 40. The seal member 40 seals a space between the drain plug 30 and the discharge hole 20*c* of the drain plug fastening part 20. In the first embodiment, play in a circumferential direction is present between the claw part 30*g* and the concave part 20*e*. Accordingly, even in a state in which the claw part 30*g* of the drain plug 30 is fit in the concave part 20*e* of the drain plug fastening part 20, the drain plug 30 is capable of slightly rotating with respect to the drain plug fastening part 20. However, even when the drain plug 30 is capable of slightly rotating with respect to the drain plug fastening part 20, it is possible to surely seal the discharge hole 20*c* with the seal member 40 in this way.

The drain plug fastening part 20 and the drain plug 30 are made of resin. However, since the claw part 30*g* is fit in the concave part 20*e*, even if the drain plug 30 is not screwed into the drain plug fastening part 20 with strong torque, reverse rotation of the drain plug 30 can be prevented. Accordingly, when the drain plug fastening part 20 and the drain plug 30 are resin, it is possible to avoid deterioration in reliability of the female thread part 20*h* and the male thread part 30*b*.

Figure 8:
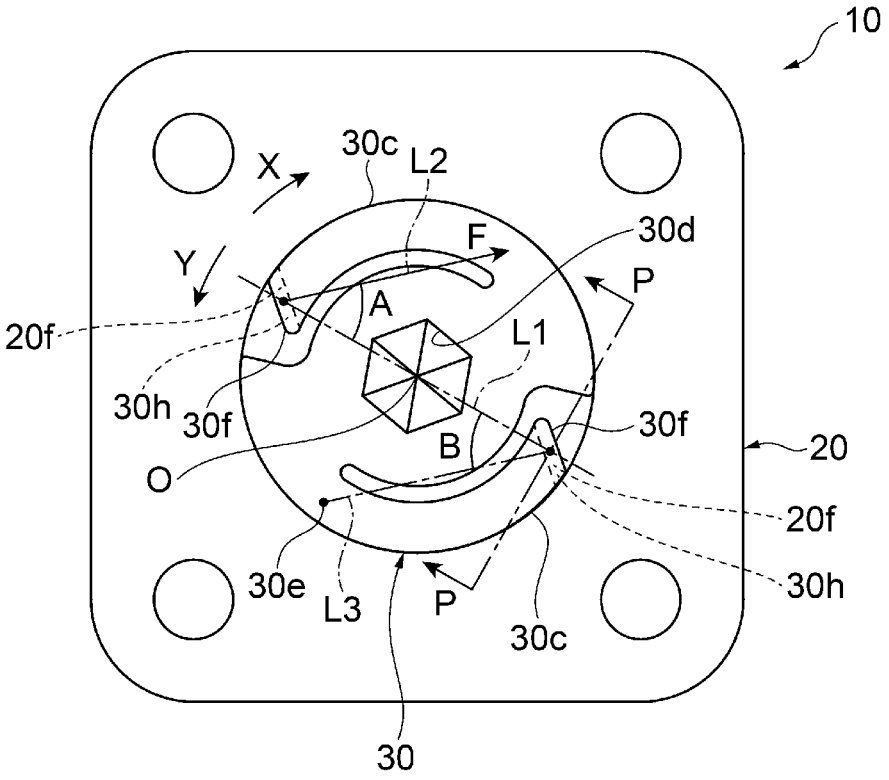
FIG. 8 is a front view of the sealing structure at the time when the drain plug is screwed into the drain plug fastening part.
Figure 9:
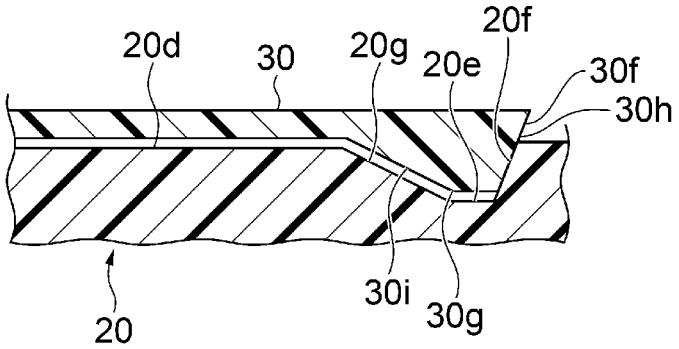
FIG. 9 is a P-P sectional view of FIG. 8.

FIG. 8 is a front view of the sealing structure 10 at the time when the drain plug 30 is screwed into the drain plug fastening part 20. FIG. 9 is a P-P sectional view of FIG. 8. One end of the main body 30*a* of the drain plug 30 is inserted into the discharge hole 20*c* of the drain plug fastening part 20 and the drain plug 30 is rotated in the normal rotation direction X by a tool, whereby the drain plug 30 is screwed into the drain plug fastening part 20 while the male thread part 30*b* of the drain plug 30 meshing with the female thread part 20*h* of the drain plug fastening part 20.

When the main body 30*a* is rotated in the normal rotation direction X using the tool, the arm part 30*c* is elastically deformed while the claw part 30*g* sliding on the top surface 20*d* (the surface) of the drain plug fastening part 20 until the main body 30*a* is rotated to a predetermined rotational position. The claw part 30*g* fits in the concave part 20*e* when the main body 30*a* is rotated to the predetermined rotational position. The elastic deformation of the arm part 30*c* is released. In this way, the main body 30*a* is prevented from rotating from the predetermined rotational position without the use of the tool. The drain plug 30 is avoided being coming off the drain plug fastening part 20 without the use of the tool.

When the main body 30*a* is rotated in the reverse rotation direction Y using the tool when the claw part 30*g* is fit in the concave part 20*e*, the claw part 30*g* slides on and climbs over the first wall part 20*f* (the wall part) of the concave part 20*e* of the claw part 30*g* while the arm part 30*c* is elastically deformed. In this way, the prevention of the rotation of the main body 30*a* from the predetermined rotational position is released.

A straight line connecting a contact part of the claw part 30*g* and the first wall part 20*f* and the rotation center O of the main body 30*a* when viewed in the rotation center O direction of the main body 30*a* when the main body 30*a* is rotated in the reverse rotation direction Y and the claw part 30*g* is sliding on the first wall part 20*f* is represented as a straight line L1. A straight line indicating a direction of force F applied to the claw part 30*g* from the first wall part 20*f*, that is, the force F applied to the arm part 30*c* from the drain plug fastening part 20 is represented as a straight line L2. A straight line connecting the contact part of the claw part 30*g* and the first wall part 20*f* and a joined part 30*e* of the arm part 30*c* and the main body 30*a* is represented as a straight line L3. Further, an angle formed by the straight line L1 and the straight line L2 is represented as an angle A. An angle formed by the straight line L1 and the straight line L3 is represented as an angle B.

In the first embodiment, the claw part 30*g* and the concave part 20*e* are formed such that the angle A and the angle B are equal. Specifically, the first inclined part 30*h* is formed such that the straight line connecting the joined part 30*e* and the center of the first inclined part 30*h* and the extending direction of the first inclined part 30*h* form a right angle when viewed in the direction of the rotation center O. The first wall part 20*f* is formed to extend in the same direction as the first inclined part 30*h* when the first wall part 20*f* comes into contact with the first inclined part 30*h*. Consequently, the arm part 30*c* is avoided being rotated around the contact part in a radial outward direction by force applied to the claw part 30*g* from the first wall part 20*f*. Accordingly, it is possible to greatly improve operability in detaching the drain plug 30 from the drain plug fastening part 20.

Note that, not only the above, but the claw part 30*g* or the concave part 20*e* may be formed such that the angle A is smaller than 90 degrees. The claw part 30*g* or the concave part 20*e* may be formed such that 90 degrees>the angle A≥the angle B holds. Consequently, when the drain plug 30 is rotated in the reverse rotation direction using a predetermined tool, it is possible to suppress the arm part 30*c* from being rotated around the contact part by force applied to the claw part 30*g* from the first wall part 20*f* Accordingly, it is possible to improve operability in detaching the drain plug 30 from the drain plug fastening part 20. The sealing structure 10 may be used for uses other than the fastening of the drain plug to the oil pan.

Figure 10:
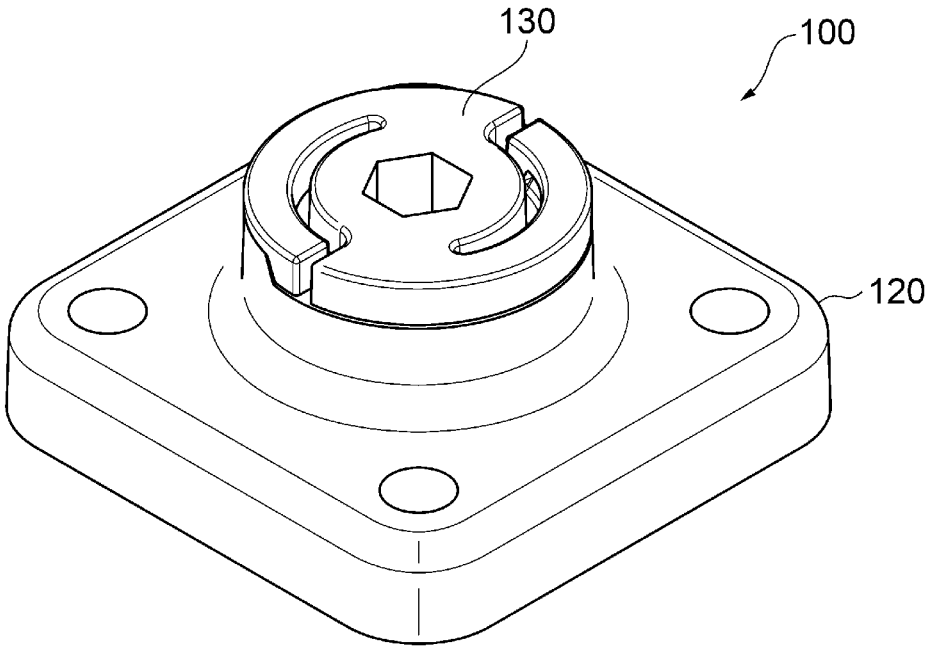
FIG. 10 is a perspective view showing a sealing structure according to a second embodiment.

FIG. 10 is a perspective view showing a sealing structure 100 according to a second embodiment. The sealing structure 100 includes a drain plug fastening part 120 (a predetermined member) and a drain plug 130 (a sealing member).

Figure 11:
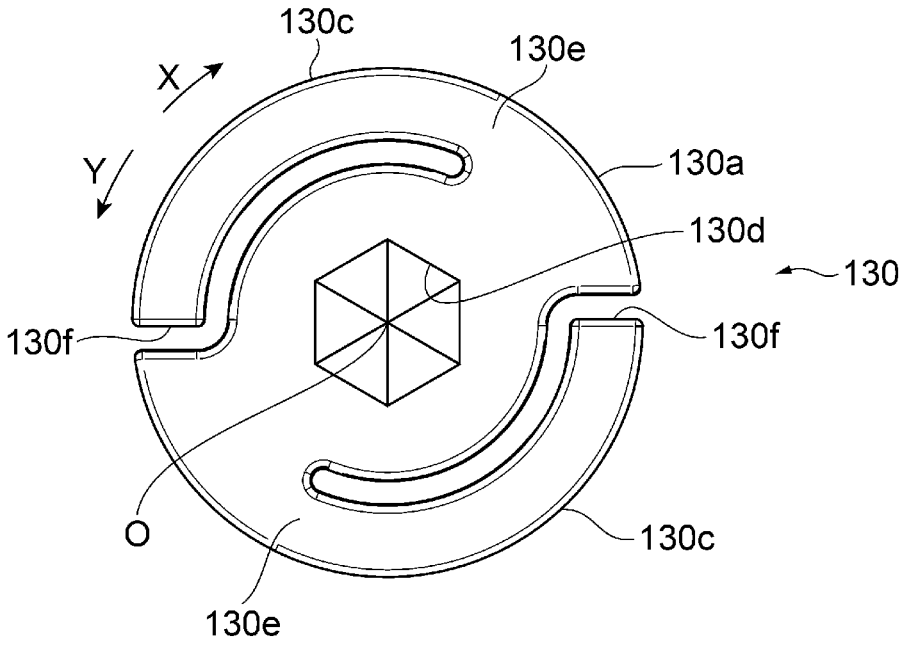
FIG. 11 is a front view of a drain plug according to the second embodiment.
Figure 12:
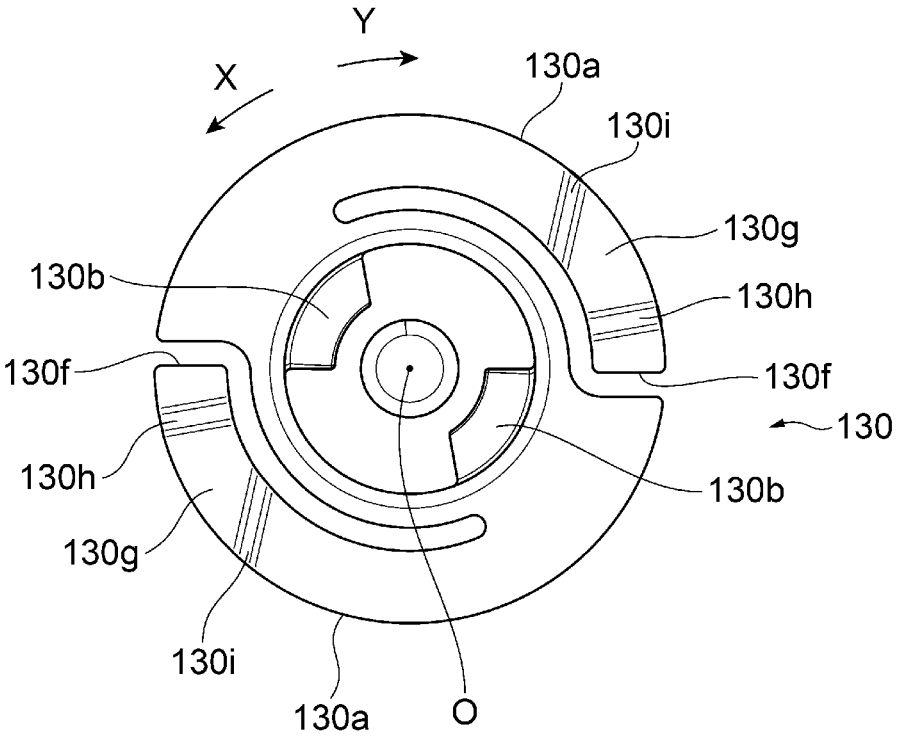
FIG. 12 is a rear view of the drain plug according to the second embodiment.

FIG. 11 is a front view of the drain plug 130 according to the second embodiment. FIG. 12 is a rear view of the drain plug 130 according to the second embodiment. The drain plug 130 includes a main body 130*a*, a male thread part 130*b*, an arm part 130*c*.

The main body 130*a* is generally formed in a columnar shape. The main body 130*a* is rotated in the normal rotation direction X, whereby the drain plug fastening part 120 is screwed into a discharge hole explained below. Consequently a discharge hole of the drain plug fastening part 120 is closed.

The arm part 130*c* is formed in an arcuate shape coaxial with the center of the main body 130*a*. One end of the arm part 130*c* is joined to the main body 130*a*. The main body 130*a*, the male thread part 130*b*, and the arm part 130*c* are integrally formed by resin. Accordingly, the arm part 130*c* is elastically deformable. In the second embodiment, the drain plug 130 includes two arm parts 130*c*. However, the drain plug 130 may include one or three or more arm parts 130*c*.

A concave part 130*g* is formed in a halfway part of the arm part 130*c*. The concave part 130*g* is present further in the reverse rotation direction Y than one end of the arm part 130*c* joined to the main body 130*a*. The concave part 130*g* is formed on the lower side of the arm part 130*c*, that is, the male thread part 130*b* side.

The concave part 130*g* includes a first wall part 130*h* and a second wall part 130*i*. The first wall part 130*h* is present further in the reverse rotation direction Y than a second wall part 103*i*. The first wall part 130*h* extends on a straight line that passes the rotation center O. The second wall part 130*i* is inclined with respect to the straight line passing the rotation center O to advance in the normal rotation direction X as advance toward the radial direction outer side.

The male thread part 130*b* is formed to extend coaxially with the main body 130*a* from one end portion of the main body 130*a*. The male thread part 130*b* is formed as a spiral groove. A pitch and a groove width of the male thread part 130*b* are extremely larger than those of a normal screw such that the drain plug 130 can be attached to the drain plug fastening part 20 by rotating the drain plug 130 once or less.

The drain plug 130 further includes a tool insertion hole 130*d*. The tool insertion hole 130*d* is the same as the tool insertion hole 30*d* in the first embodiment.

Figure 13:
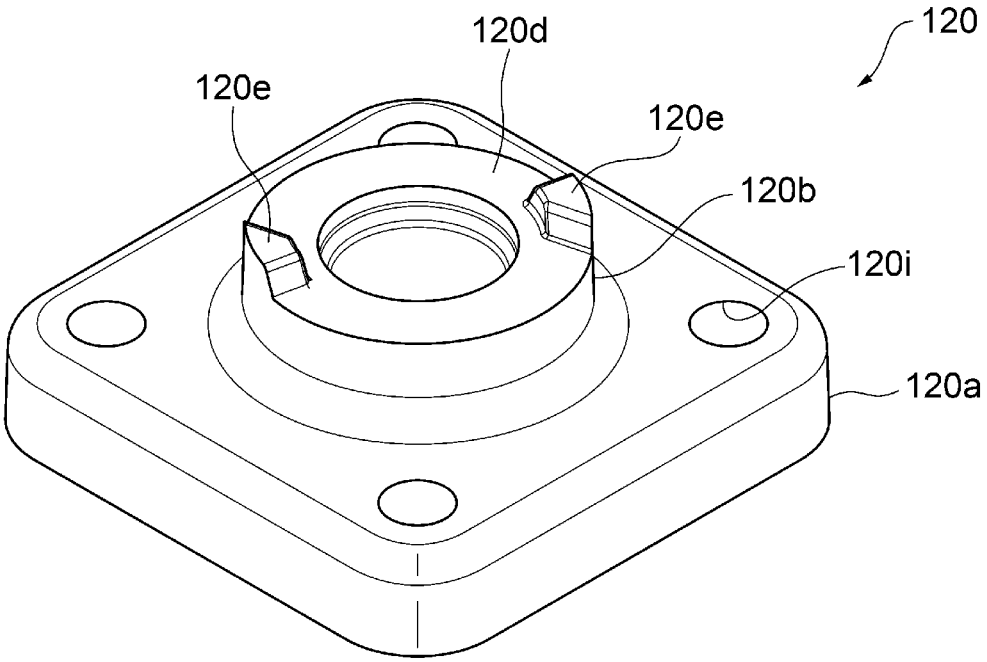
FIG. 13 is a perspective view showing a drain plug fastening part according to the second embodiment.
Figure 14:
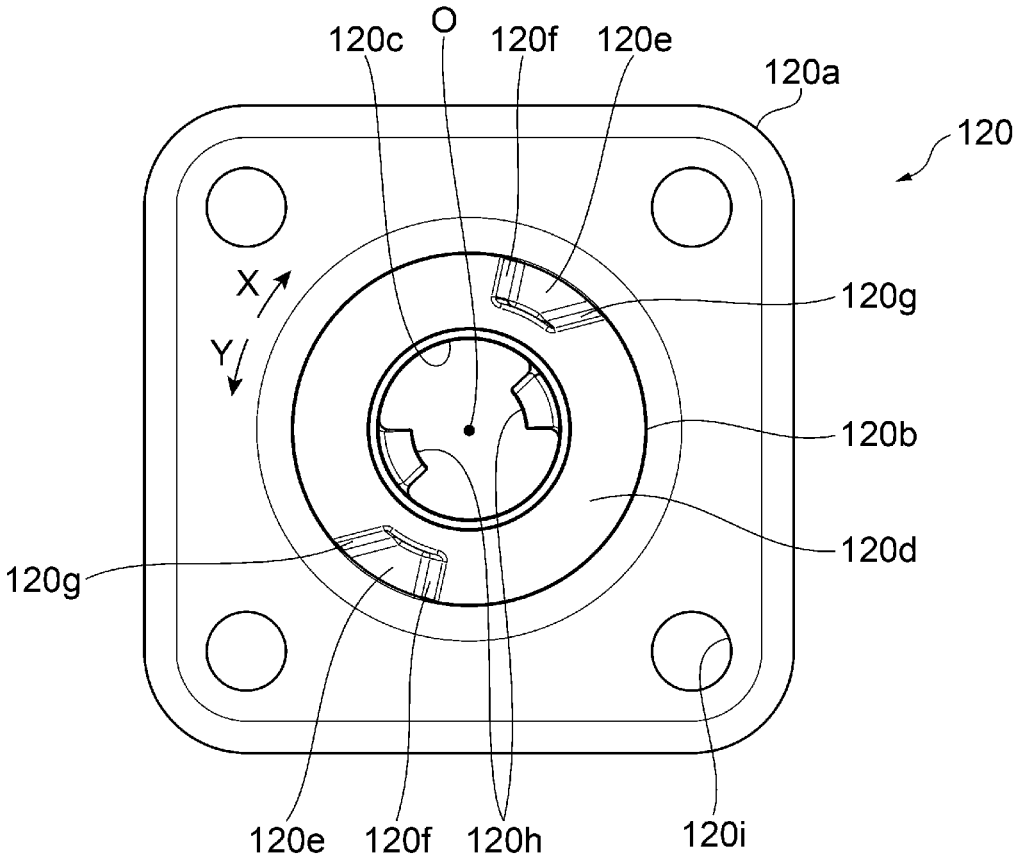
FIG. 14 is a front view of the drain plug fastening part according to the second embodiment.

FIG. 13 is a perspective view showing the drain plug fastening part 120 according to the second embodiment. FIG. 14 is a front view of the drain plug fastening part 120 according to the second embodiment. The drain plug fastening part 120 includes a base part 120*a*, a projecting part 120*b*, and a discharge hole 120*c*. The base part 120*a* is formed in a rectangular parallelepiped shape. Four attachment holes 120*i* are formed in the base part 120*a*. The drain plug fastening part 120 is fixed to an oil pan main body through the attachment holes 120*i* using a fastening tool. Therefore, the drain plug fastening part 120 forms a part of the oil pan.

The projecting part 120*b* projects from one surface of the base part 120*a*. The projecting part 120*b* is formed in a columnar shape. A top surface 120*d*, which is an annular plane, is formed at the distal end of the projecting part 120*b*. A convex part 120*e* is formed to project from the top surface 120*d*.

The convex part 120*e* includes a first inclined part 120*f* and a second inclined part 120*g*. The first inclined part 120*f* is present further in the reverse rotation direction Y than the second inclined part 120*g*. The first inclined part 120*f* and the second inclined part 120*g* are inclined to be closer to each other as progress toward a projecting direction of the convex part 120*e*. When the drain plug 130 is rotated in the positive rotation direction X, the first inclined part 120*f* comes into contact with the first wall part 130*h* of the drain plug 130. When the drain plug 130 is rotated in the reverse rotation direction Y, the second inclined part 120*g* comes into contact with the second wall part 130*i* of the drain plug 130. Accordingly, an inclination angle of the first wall part 130*h* is the same as an inclination angle of the first inclined part 120*f*. An inclination angle of the second wall part 130*i* is the same as an inclination angle of the second inclined part 12*g*.

The first inclined part 120*f* extends on a straight line that passes the rotation center O. The second inclined part 120*g* is inclined with respect to the straight line passing the rotation center O to advance in the positive rotation direction X as advance toward the radial outer side.

The discharge hole 120*c* is formed in the center of the projecting part 120*b*. A female thread part 120*h* is formed in the discharge hole 120*c*. The discharge hole 120*c* and the female thread part 120*h* are the same as the discharge hole 20*c* and the female thread part 20*h* according to the first embodiment.

In the second embodiment as well, the sealing structure 100 further includes a seal member (not illustrated). The seal member seals a space between the drain plug 130 and the discharge hole 120*c* of the drain plug fastening part 120. In the second embodiment, play in a circumferential direction is present between the concave part 130*g* and the convex part 120*e*. Accordingly, even in a state in which the convex part 120*e* of the drain plug 30 is fit in the concave part 130*g*, the drain plug 130 is capable of slightly rotating with respect to the drain plug fastening part 120. However, even when the drain plug 130 is capable of slightly rotating with respect to the drain plug fastening part 120, the discharge hole 120*c* can be surely sealed by the seal member in this way.

The drain plug fastening part 120 and the drain plug 130 are made of resin. However, since the convex part 120*e* is fit in the concave part 130*g*, even if the drain plug 130 is not screwed into the drain plug fastening part 120 with strong torque, reverse rotation of the drain plug 130 can be prevented as in the first embodiment.

Figure 15:
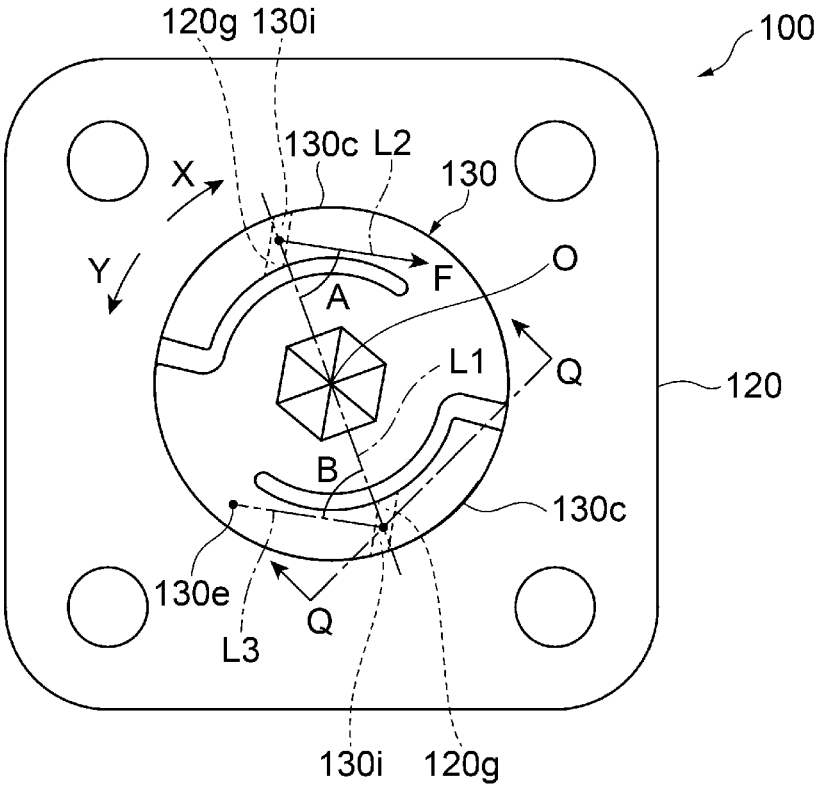
FIG. 15 is a front view of the sealing structure at the time when the drain plug is screwed into the drain plug fastening part.
Figure 16:
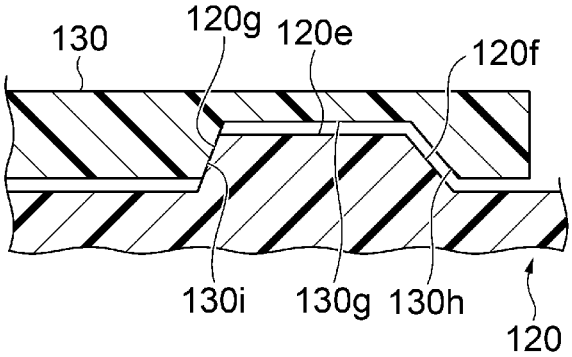
FIG. 16 is a Q-Q sectional view of FIG. 15.

FIG. 15 is a front view of the sealing structure 100 at the time when the drain plug 130 is screwed into the drain plug fastening part 120. FIG. 16 is a Q-Q sectional view of FIG. 14. One end of the main body 130*a* of the drain plug 130 is inserted into the discharge hole 120*c* of the drain plug fastening part 120 and the drain plug 130 is rotated in the normal rotation direction X by a tool, whereby the drain plug 130 is screwed into the drain plug fastening part 120 while the male thread part 130*b* of the drain plug 130 meshing with the female thread part 120*h* of the drain plug fastening part 120.

When the main body 130*a* is rotated in the normal rotation direction X, the arm part 130*c* is elastically deformed while a part of the arm part 130*c* slides on the top surface 120*d* (the surface) of the drain plug fastening part 120 until the main body 130*a* is rotated to a predetermined rotational position. When the main body 130*a* is rotated to the predetermined rotational position, the convex part 120*e* fits in the concave part 130*g* and the elastic deformation of the arm part 130*c* is released. In this way, the main body 130*a* is prevented from rotating from the predetermined rotational position without the use of the tool. The drain plug 130 is avoided coming off the drain plug fastening part 120 without the use of the tool.

When the main body 130*a* is rotated in the reverse rotation direction Y using the tool, the convex part 120*e* slides on and climbs over the second wall part 130*i* (a wall part) of the concave part 130*g* while the arm part 130*c* is elastically deformed. In this way, the prevention of the rotation of the main body 130*a* from the predetermined rotational position is released.

A straight line connecting a contact part of the second inclined part 120*g* and the second wall part 130*i* and the rotation center O of the main body 130*a* when viewed in the rotation center O direction of the main body 130*a* when the main body 130*a* is rotated in the reverse rotation direction Y and the second inclined part 120*g* is sliding on the second wall part 130*i* is represented as the straight line L1. A straight line indicating a direction of the force F applied to the second wall part 130*i* from the second inclined part 120*g*, that is, the force F applied to the arm part 130*c* from the drain plug fastening part 120 is represented as the straight line L2. A straight line connecting the contact part of the second inclined part 120*g* and the second wall part 130*i* and a joined part 130*e* of the arm part 130*c* and the main body 130*a* is represented as the straight line L3. Further, an angle formed by the straight line L1 and the straight line L2 is represented as the angle A. An angle formed by the straight line L1 and the straight line L3 is represented as the angle B.

In the second embodiment as well, the convex part 120*e* and the concave part 130*g* are formed such that the angle A and the angle B are equal. Specifically, the second wall part 130*i* is formed such that the straight line connecting the joined part 130*e* and the center of the second wall part 130*i* and the extending direction of the second wall part 130*i* form a right angle when viewed in the direction of the rotation center O. The second inclined part 120*g* is formed to extend in the same direction as the second wall part 130*i* when the second inclined part 120*g* comes into contact with the second wall part 130*i*. Consequently, the arm part 130*c* is avoided being rotated around the contact part in a radial outward direction by the force F applied to the second wall part 130*i* from the second inclined part 120*g*. Accordingly, it is possible to greatly improve operability in detaching the drain plug 130 from the drain plug fastening part 120.

Note that, not only the above, but the concave part 130*g* and the convex part 120*e* may be formed such that the angle A is smaller than 90 degrees. The concave part 130*g* and the convex part 120*e* may be formed such that 90 degrees>the angle A≥the angle B holds. Consequently, when the drain plug 130 is rotated in the reverse rotation direction using a predetermined tool, it is possible to suppress the arm part 130*c* from being rotated around the contact part by the force F applied to the second wall part 130*i* from the second inclined part 120*g*. Accordingly, it is possible to improve operability in detaching the drain plug 130 from the drain plug fastening part 120. The sealing structure 100 may be used for uses other than the fastening of the drain plug to the oil pan.

The present invention is explained above with reference to the embodiment. However, the present invention is not limited to the embodiment explained above. Appropriate combinations and substitutions of the components in the embodiment are also included in the present invention. It is also possible to appropriately rearrange the combinations and the order of the processing in the embodiment and add various modifications such as design changes to the embodiment based on the knowledge of those skilled in the art. The embodiment applied with such modifications could be included in the scope of the present invention.

The invention claimed is:

1. A sealing structure comprising:

a predetermined member including an opening part; and a sealing member for sealing the opening part of the predetermined member, wherein the sealing member includes:

a main body;

a thread part fixed to the main body, wherein if the main body is rotated in a normal rotation direction, the thread part is screwed into the opening part of the predetermined member; and an elastically deformable arm part joined to the main body at one end thereof, wherein a convex part is formed in one of the predetermined member and the arm part and a concave part is formed in another of the predetermined member and the arm part, if the main body is rotated in the normal rotation direction, the arm part is elastically deformed while a part of the arm part slides on a surface of the predetermined member until the main body is rotated to a predetermined rotational position and, when the main body is rotated to the predetermined rotational position, the convex part fits in the concave part and the elastic deformation of the arm part is released, whereby the rotation of the main body from the predetermined rotational position is prevented, if the main body is rotated to a reverse rotation direction from the predetermined rotational position, the convex part slides on and climbs over a wall part of the concave part while the arm part is elastically deformed, whereby the prevention of the rotation of the main body from the predetermined rotational position is released, wherein the convex part or the concave part is formed such that, when the main body is being rotated in the reverse rotation direction and the convex part is sliding on the wall part, an angle A formed by a direction of force applied to the arm part from the predetermined member and a straight line connecting a contact part of the convex part and the wall part and a rotation center of the main body is smaller than 90 degrees when viewed in a rotation center direction of the main body, and wherein the convex part has a first inclined part and a second inclined part, the first inclined part disposed further in the reverse rotation direction than the second inclined part, wherein the second inclined part extends on a straight line that passes through the rotation center, and the first inclined part is inclined relative to the straight line and extends towards the straight line in a radially outer direction such that a radially outer side of the first inclined part is disposed further in the normal rotation direction than a radially inner side of the first inclined part.

2. The sealing structure according to claim 1, wherein, when an angle formed by a straight line connecting the contact part of the convex part and the wall part and a joined part of the arm part and the main body and the straight line connecting the contact part of the convex part and the wall part and the rotation center of the main body is represented as an angle B, the convex part or the concave part is formed such that 90 degrees>the angle A≥the angle B holds.

3. The sealing structure according to claim 2, wherein the convex part or the concave part is formed such that the angle A and the angle B are equal.

4. The sealing structure according to claim 1, wherein the concave part is formed in the predetermined member and the convex part is formed in the arm part.

5. The sealing structure according to claim 1, wherein the convex part is formed in the predetermined member and the concave part is formed in the arm part.

6. The sealing structure according to claim 1, wherein the predetermined member is made of resin.

7. The sealing structure according to claim 1, wherein the predetermined member is an oil pan, and the sealing member is a drain plug.

8. The sealing structure according to claim 1, wherein the concave part includes a first inclined wall part and a second inclined wall part, the first inclined wall part disposed further in the reverse rotation direction than the second inclined wall part, wherein the second inclined wall part extends on a straight line that passes through the rotation center, and the first inclined wall part is inclined relative to the straight line and extends towards the straight line in a radially outer direction such that a radially outer side of the first inclined wall part is disposed further in the normal rotation direction than a radially inner side of the first inclined wall part.

9. The sealing structure according to claim 8, wherein the predetermined member further includes a base part and a projecting part projecting from the base part, and wherein the concave part is disposed on the projecting part and recessed from a top surface thereof.

10. The sealing structure according to claim 1, wherein the convex part is provided on the arm part, and wherein an inclination of the first inclined part extends from a first axial side of the arm part facing towards the predetermined member to a second axial side of the arm part facing away from the predetermined member.

11. The sealing structure according to claim 1, wherein the sealing member includes at least two elastically deformable arm parts that each include the convex part, and wherein the predetermined member includes at least two concave parts disposed thereon that interact with the convex part of the at least two arm parts.

12. The sealing structure according to claim 1, wherein the arm part is composed of resin.

13. A sealing structure comprising:

a predetermined member including an opening part; and a sealing member for sealing the opening part of the predetermined member, wherein the sealing member includes:

a main body;

a thread part fixed to the main body, wherein if the main body is rotated in a normal rotation direction, the thread part is screwed into the opening part of the predetermined member; and an elastically deformable arm part joined to the main body at one end thereof, wherein a convex part is formed in one of the predetermined member and the arm part and a concave part is formed in another of the predetermined member and the arm part, if the main body is rotated in the normal rotation direction, the arm part is elastically deformed while a part of the arm part slides on a surface of the predetermined member until the main body is rotated to a predetermined rotational position and, when the main body is rotated to the predetermined rotational position, the convex part fits in the concave part and the elastic deformation of the arm part is released, whereby the rotation of the main body from the predetermined rotational position is prevented, if the main body is rotated to a reverse rotation direction from the predetermined rotational position, the convex part slides on and climbs over a wall part of the concave part while the arm part is elastically deformed, whereby the prevention of the rotation of the main body from the predetermined rotational position is released, wherein the convex part or the concave part is formed such that, when the main body is being rotated in the reverse rotation direction and the convex part is sliding on the wall part, an angle A formed by a direction of force applied to the arm part from the predetermined member and a straight line connecting a contact part of the convex part and the wall part and a rotation center of the main body is smaller than 90 degrees when viewed in a rotation center direction of the main body, and wherein the concave part includes a first inclined wall part and a second inclined wall part, the first inclined wall part disposed further in the reverse rotation direction than the second inclined wall part, wherein the second inclined wall part extends on a straight line that passes through the rotation center, and the first inclined wall part is inclined relative to the straight line and extends towards the straight line in a radially outer direction such that a radially outer side of the first inclined wall part is disposed further in the normal rotation direction than a radially inner side of the first inclined wall part.

14. The sealing structure according to claim 13, wherein the convex part has a first inclined part and a second inclined part, the first inclined part disposed further in the reverse rotation direction than the second inclined part, wherein the second inclined part extends on a straight line that passes through the rotation center, and the first inclined part is inclined relative to the straight line and extends towards the straight line in a radially outer direction such that a radially outer side of the first inclined part is disposed further in the normal rotation direction than a radially inner side of the first inclined part.

15. The sealing structure according to claim 14, wherein the convex part is disposed on the arm part and the concave part is disposed on the predetermined member.

16. The sealing structure according to claim 13, wherein the predetermined member is a drain plug fastening part that includes a base part and a projecting part with a discharge hole defining the opening part formed in a center of the projecting part, and wherein the concave part is disposed on the projecting part and recessed from a top surface thereof.

17. The sealing structure according to claim 13, wherein the convex part is provided on the arm part and has a first inclined part and a second inclined part, the first inclined part disposed further in the reverse rotation direction than the second inclined part, wherein an inclination of the first inclined part extends from a first axial side of the arm part facing towards the predetermined member to a second axial side of the arm part facing away from the predetermined member.

18. A sealing structure comprising:

a predetermined member including an opening part; and a sealing member for sealing the opening part of the predetermined member, wherein the sealing member includes:

a main body;

a thread part fixed to the main body, wherein if the main body is rotated in a normal rotation direction, the thread part is screwed into the opening part of the predetermined member; and an elastically deformable arm part joined to the main body at one end thereof, wherein a convex part is formed in one of the predetermined member and the arm part and a concave part is formed in another of the predetermined member and the arm part, if the main body is rotated in the normal rotation direction, the arm part is elastically deformed while a part of the arm part slides on a surface of the predetermined member until the main body is rotated to a predetermined rotational position and, when the main body is rotated to the predetermined rotational position, the convex part fits in the concave part and the elastic deformation of the arm part is released, whereby the rotation of the main body from the predetermined rotational position is prevented, if the main body is rotated to a reverse rotation direction from the predetermined rotational position, the convex part slides on and climbs over a wall part of the concave part while the arm part is elastically deformed, whereby the prevention of the rotation of the main body from the predetermined rotational position is released, wherein the convex part is provided on the arm part and has a first inclined part and a second inclined part, the first inclined part disposed further in the reverse rotation direction than the second inclined part, wherein an inclination of the first inclined part extends from a first axial side of the arm part facing towards the predetermined member to a second axial side of the arm part facing away from the predetermined member.

19. The sealing structure according to claim 18, wherein the second inclined part extends on a straight line that passes through a rotation center of the main body, and the first inclined part is inclined relative to the straight line and extends towards the straight line in a radially outer direction such that a radially outer side of the first inclined part is disposed further in the normal rotation direction than a radially inner side of the first inclined part.

20. The sealing structure according to claim 18, wherein the concave part includes a first inclined wall part and a second inclined wall part, the first inclined wall part disposed further in the reverse rotation direction than the second inclined wall part, wherein the second inclined wall part extends on a straight line that passes through the rotation center, and the first inclined wall part is inclined relative to the straight line and extends towards the straight line in a radially outer direction such that a radially outer side of the first inclined wall part is disposed further in the normal rotation direction than a radially inner side of the first inclined wall part.

* * * * *